US006517643B1

(12) United States Patent
Asahi et al.

(10) Patent No.: US 6,517,643 B1
(45) Date of Patent: Feb. 11, 2003

(54) STEEL HAVING EXCELLENT OUTER SURFACE SCC RESISTANCE FOR PIPELINE

(75) Inventors: Hitoshi Asahi, Futtsu (JP); Shigeo Okano, Kakogawa (JP); Takahiro Kushida, Osaka (JP); Yasuyoshi Yamane, Chiba (JP); Hideaki Fukai, Tokyo (JP)

(73) Assignees: Nippon Steel Corporation, Tokyo (JP); Kabushiki Kaisha Kobe Seiko Sho, Hyogo (JP); NKK Corporation, Tokyo (JP); Kawasaki Steel Corporation, Hyogo (JP); Sumitomo Metals Industries, Ltd., Osaka (JP)

( * ) Notice: Subject to any disclaimer, the term of this patent is extended or adjusted under 35 U.S.C. 154(b) by 0 days.

(21) Appl. No.: 09/202,989

(22) PCT Filed: Jun. 26, 1997

(86) PCT No.: PCT/JP97/02220

§ 371 (c)(1),
(2), (4) Date: Dec. 23, 1998

(87) PCT Pub. No.: WO98/00569

PCT Pub. Date: Jan. 8, 1998

(30) Foreign Application Priority Data

Jun. 28, 1996 (JP) ..... 8-170004

(51) Int. Cl.[7] ..... C21D 7/06; C22C 38/00
(52) U.S. Cl. ..... 148/320; 148/909
(58) Field of Search ..... 148/320, 909; 428/687; 138/177

(56) References Cited

U.S. PATENT DOCUMENTS

| | | | | | |
|---|---|---|---|---|---|
| 3,668,912 | A | * | 6/1972 | Baughman et al. | 72/53 |
| 3,973,999 | A | * | 8/1976 | Nakayama et al. | |
| 4,144,378 | A | * | 3/1979 | Kim | 428/653 |
| 4,784,922 | A | * | 11/1988 | Yoshimura | 428/681 |
| 5,030,064 | A | * | 7/1991 | Usami et al. | 416/241 R |
| 5,180,322 | A | * | 1/1993 | Yamamoto et al. | 445/37 |
| 5,252,151 | A | * | 10/1993 | Inoue et al. | |
| 5,286,315 | A | * | 2/1994 | Iwayama et al. | 148/538 |
| 6,088,895 | A | * | 7/2000 | Nelson et al. | 29/81.01 |

FOREIGN PATENT DOCUMENTS

| | | | | |
|---|---|---|---|---|
| JP | 53-104531 | | | 9/1978 |
| JP | 55-104425 | | | 8/1980 |
| JP | 58-67821 | | | 4/1983 |
| JP | 62-217184 | | | 9/1987 |
| JP | 62217184 | A | * | 9/1987 |
| JP | 3-12590 | | | 1/1991 |
| JP | 03012590 | A | * | 1/1991 |
| JP | 03-271317 | | | 12/1991 |
| JP | 6-93354 | | | 4/1994 |
| JP | 07-166238 | | | 6/1995 |
| JP | 10298691 | A | * | 11/1998 |

OTHER PUBLICATIONS

Shepard, S.W., "Chemical Process Equipment Corrosion", Corrosion, vol. 17, Mar. 1961, pp. 19–20.*

T. Kaneko et al, "Factors on the Method of Sulfide Stress Corrosion Cracking in Oil Country Tubular Goods", Third International Congress on Hydrogen and Materials, Jun. 7–11, 1982, pp. 965–970.*

Patent Abstracts of Japan, vol. 013, No. 262 (C–608), Jun. 16, 1989, & JP 01 065229 A (Nippon Steel Corp.), Mar. 10, 1989.

M.S. Baxa, et al., "Effects of Sodium Chloride and Shot Peening on Corrosion Fatique of AISI 6150 Steel", Metallurgical Transactions, vol. 9a, Aug. 1978, pp. 1141–1146, XP002115568, Metallurgical Society of Aime, New York, US.

Asensio, J. et al., "Quantitative Metallographic Characterization of an APIX–65 Steel Partially Deformed in +β for Pipeline Applications", MC95, Proceedings of the International Metallography Conference, May 10–12, 1995, Colmar, France, pp. 49–57.

* cited by examiner

*Primary Examiner*—Roy King
*Assistant Examiner*—Harry D. Wilkins, III
(74) *Attorney, Agent, or Firm*—Kenyon & Kenyon

(57) ABSTRACT

A steel pipe is provided which is excellent in resistance to outer surface stress corrosion cracking (SCC) when used for a pipeline without impairing the fundamental requirement for the steel as a pipeline. The steel pipe has a surface adjusted to have a mean line roughness Ra of up to 7 μm and a maximum height Rmax of up to 50 μm. The surface is adjusted by sand blasting to have this roughness.

4 Claims, No Drawings

STEEL HAVING EXCELLENT OUTER SURFACE SCC RESISTANCE FOR PIPELINE

FIELD OF THE INVENTION

The present invention relates to a low alloy steel on which so-called outer surface SCC (stress corrosion cracking) taking place on a steel-made pipeline buried in soil under cathodic protection hardly occurs. The low alloy steel can be widely used for line pipes for the transportation of crude oil and natural gas and as a structural steel which are used under similar conditions.

DESCRIPTION OF THE RELATED ART

The outer surface SCC of pipelines, as discussed herein, is most often reported in cases related to corrosion in pipeline accidents. Only countermeasures such as making the coating sound and early replacement of pipelines subsequent to the formation of outer surface SCC have been taken conventionally, and no countermeasures have been taken regarding steel pipe materials. "The effects of alloying additions of ferritic steels upon stress corrosion cracking resistance" (by R. N. Parkins, P. W. Slattery and B. S. Poulson, Corrosion, vol. 37 (1981) No. 11, pp 650–664) discloses that a steel shows an improvement of resistance to outer surface SCC as a pipeline when the steel contains 0.86% by mass of Ti, 1.75% by mass of Cr, 6.05% by mass of Ni and 5% by mass of Mo. A steel containing such large amounts of alloying elements hardly satisfies other important properties such as weldability and cannot be put into practical use because the steel is costly.

DISCLOSURE OF THE INVENTION

An object of the present invention is to provide a steel excellent in resistance to outer surface SCC when used for a pipeline, without impairing the fundamental requirements of the pipeline.

The present inventors have conducted tests reproducing resistance to outer surface SCC of steels used for pipelines which steels have such chemical compositions that the steels have strength, low temperature toughness and weldability necessary for the line pipes. As a result, they have found the conditions of a steel which improve the resistance to outer surface SCC when the steel is used for a pipeline. That is, they have discovered that the resistance to outer surface SCC of a pipeline can be improved by making the surface of the steel smooth on the average and the magnitudes of the roughness smaller than a certain level, and lowering the C content with regards to the chemical composition of the steel composition. Moreover, they also have found that the resistance to outer surface SCC of the pipeline is further improved by shot-blasting the steel so that the steel satisfies a roughness to a certain level. The outer surface SCC of a pipeline is thought to take place when magnetite thinly formed on the surface is cracked by stress fluctuation and iron is dissolved from the resultant cracks. Accordingly, when the microscopic plastic deformation of the steel is suppressed to inhibit the cracking of magnetite, the outer surface SCC hardly takes place. Furthermore, when the microstructure of the steel is uniform, the properties are further improved.

The present invention has been constituted based on the discoveries as mentioned above.

That is, the present invention provides steels as mentioned below.

A steel excellent in resistance to outer surface SCC when used for a pipeline, wherein said steel has a surface adjusted to have a mean line roughness Ra of up to 7 $\mu$m and a maximum height Rmax of up to 50 $\mu$m.

A steel excellent in resistance to outer surface SCC when used for a pipeline, wherein said steel has a surface adjusted by shot blasting to have a mean line roughness Ra of up to 7 $\mu$m and a maximum height Rmax of up to 50 $\mu$m. The steel further comprising, based on mass, 0.03 to 0.16% of C, 0.5 to 2.0% of Mn, up to 0.5% of Si, up to 0.02% of P, up to 0.01% of S, up to 0.10% of Al, up to 0.1% of N, one or more kinds of the following elements in the following contents: 0.005 to 0.1% of Nb, 0.005 to 0.1% of Ti, 0.001 to 0.1% of V, 0.03 to 0.5% of Mo, 0.1 to 0.6% of Cr, 0.1 to 0.8% of Ni, 0.1 to 0.8% of Cu, 0.0003 to 0.003% of B and 0.001 to 0.01% of Ca and the balance being substantially Fe and unavoidable impurities.

Furthermore, the steel having, as the principal microstructure, acicular ferrite, bainitic ferrite or bainite.

In addition, the display of a surface roughness in the present invention is based on the specification of JIS B0601, and Ra and Rmax represent a mean line roughness and a maximum height, respectively.

DESCRIPTION OF THE PREFERRED EMBODIMENTS

The present invention will be explained below in detail.

First, reasons for restricting the surface roughness of the steel will be explained. The importance of a surface roughness of a steel to the resistance to outer surface SCC has not been recognized. As a result of examining several arbitrarily selected steel pipes, Ra and Rmax have been found to vary from 5 to 30 $\mu$m and from 20 to 300 $\mu$m, respectively.

It is expected from the mechanism of the outer surface SCC as described above that a smooth surface of a steel is desirable for improving the resistance thereto. In fact, a steel having a mechanically ground surface hardly suffers outer surface SCC. Therefore, various steels mainly including steels used for line pipes were prepared. Steels having a surface roughness ranging widely among them were prepared therefrom by changing rolling and processing procedures, and the resistance to outer surface SCC of the steels was evaluated. As a result, it has been found that both the center line mean roughness Ra and the maximum height Rmax of a steel which are the indexes of a surface roughness of the material influence the resistance to outer surface SCC. That is, it has been found that a steel is likely to suffer outer surface SCC when Ra and Rmax of the steel exceed 7 $\mu$m and 50 m, respectively. Accordingly, the surface roughness of the steel is defined as follows: $Ra \leqq 7$ $\mu$m and $Rmax \leqq 50$ $\mu$m. In order to further improve the resistance to outer surface SCC of the steel, it is particularly desirable that $Ra \leqq 5$ $\mu$m and $Rmax \leqq 35$ $\mu$m.

Furthermore, the following phenomenon has been found: a steel which is shot-blasted on the surface shows improved resistance to outer surface SCC compared with the same steel which is treated otherwise to have the same surface roughness as that of the steel mentioned above. The results are thought to be brought about because the worked layer and the compressive residual stress formed by shot blasting contribute to the improvement. Shot blasting is, therefore, particularly preferred as a surface-adjusting method.

Such control of the surface shape of the steel improves the resistance to outer surface SCC. Restriction of the chemical composition of the steel to a specific range in addition to the control further improves the resistance to outer surface SCC.

Reasons for restricting the chemical composition of the steel of the present invention will be explained below.

The content of C is restricted to 0.03 to 0.16%. C is extremely effective in improving the strength of the steel. In order to obtain a strength as a structural steel, a minimum content of at least 0.03% is necessary. However, since the nonuniformity of the microstructure is increased and the resistance to outer surface SCC is lowered as the C content is increased, the upper limit of the C content is defined to be 0.16%. When the C content exceeds 0.10%, a ferrite-pearlite microstructure is not formed, and a proper strength of the steel becomes difficult to obtain. The upper limit of the C content should preferably be restricted to 0.10%.

Si is an element which is added to the steel to effect deoxidization and improve the strength, and Si is not directly related to the resistance to outer surface SCC. Since addition of Si in a large amount impairs the fundamental properties of the steel as a line pipe such as HAZ toughness and field weldability, the upper limit of the Si content is defined to be 0.5%. However, the steel can also be deoxidized with other elements such as Al, and addition of Si is not necessarily required.

Mn is an element necessary for highly strengthening the steel while a low C content of the steel which is good for the resistance to outer surface SCC is being maintained. The effect of Mn is insignificant when the Mn content is less than 0.5%. Segregation becomes significant and a hard phase which is detrimental to the resistance to outer surface SCC tends to appear when the Mn content exceeds 2.0%. Moreover, the field weldability is also deteriorated. Accordingly, the Mn content is defined to be from 0.5 to 2.0%.

The content of P which is an impurity of the steel is restricted to up to 0.02% mainly because the restriction has the effect of improving the resistance to outer surface SCC of a pipeline which proceeds in the form of intergranular cracking as well as further improving the low temperature toughness of the base material and HAZ.

The content of S which is an impurity of the steel is restricted to up to 0.01% mainly because the restriction decreases MnS which is elongated by hot rolling and has the effect of improving the ductility and toughness.

Al is an element usually contained in the steel as a deoxidizing agent, and it also has the effect of refining the microstructure. However, when the Al content exceeds 0.10%, Al-based nonmetallic oxides increase, and the low temperature toughness is deteriorated. Accordingly, the upper limit of the Al content is defined to be 0.10%. However, deoxidization can also be conducted with other elements such as Si, and Al is not necessarily required to be added.

Although N is also an element which is difficult to remove from the steel, it sometimes forms AlN, TiN, etc., and achieves the effect of refining the microstructure. However, when the steel contains an excessively large amount of N, deterioration of the low temperature toughness, strain aging embrittlement, etc. result. The upper limit of the N content is, therefore, defined to be 0.1%.

The object of adding Nb, Ti, V, Mo, Cr, Ni, Cu, B and Ca will be explained. The principal object of further adding the elements in addition to the fundamental constituent elements is to further improve the resistance to outer surface SCC and enlarge the application range without impairing the excellent properties of the steel of the present invention. Such elements themselves do not exert a direct influence on the resistance to outer surface SCC. That is, the object is to highly strengthen the steel while a low C content of the steel which is good for the resistance to outer surface SCC is being maintained, and to refine the microstructure of the steel so that the nonuniformity of the microscopic strains and cracking of magnetite are suppressed; consequently, the object is to further improve the resistance to outer surface SCC. Accordingly, the elements mentioned above are not necessarily required to be contained. Moreover, the addition amount should naturally be restricted. In addition, the lower limit addition amounts of the above-mentioned elements are defined as amounts under which the addition effects become insignificant.

Nb and Ti herein have the effects of suppressing austenite grain coarsening and refining the microstructure of the steel during hot working or heat treatment. However, since the addition of Nb or Ti in an amount exceeding 0.1% exert adverse effects on the HAZ toughness and field weldability, the upper limit of the addition amount is defined to be 0.1%. Since the effect of adding Ti and Nb on refining the microstructure is great, addition of Ti and Nb in an amount of at least 0.005% is desirable.

V, Mo, Cr, Ni and Cu are added to improve the quench-hardenability of the steel and realize a highly strengthened steel through the formation of precipitates. The following upper limit contents have been determined not to deteriorate the field weldability and not to impair the economic advantage: V: 0.1%, Mo: 0.5%, Cr: 0.6%, Ni: 0.8% and Cu: 0.8%. On the other hand, addition of B in an amount of at least 0.0003% contributes to highly strengthening the steel exclusively through the improvement of the quench-hardenability. However, since the addition thereof in an amount exceeding 0.003% produces the deterioration of the low temperature toughness, the upper limit of the B content is defined to be 0.003%.

Addition of Ca in an amount of at least 0.001% controls the morphology of sulfides, and improves the low temperature toughness of the steel. However, addition of Ca in an amount of up to 0.001% shows practically no effect. Since addition thereof in an amount exceeding 0.01% results in forming large inclusions and exerts adverse effects on the low temperature toughness, the upper limit of the Ca content is defined to be 0.01%.

Next, reasons for restricting the microstructure of the steel will be explained below. As stated above, the outer surface SCC of a pipeline takes place from cracks of magnetite caused by the nonuniformity of a microscopic plastic deformation; therefore, when the microstructure is uniform, differences among microscopic deformations become small, and the outer surface SCC hardly takes place. When mild and large polygonal ferrite formed at high temperature is present in the microstructure, microscopic deformation is likely to take place. Accordingly, the microstructure is restricted to one principally having acicular ferrite, bainitic ferrite or bainite in which such ferrite is not formed. That is, even for a steel of the present invention having a constant chemical composition, the outer surface SCC of the steel can be improved further by changing the microstructure from ferrite-pearlite to acicular ferrite using a procedure such as a procedure of increasing the cooling rate of the steel. In addition, since the outer surface SCC takes place from a surface, it is needless to say that the microstructure of the top surface layer is important. When the decarburized layer of a surface of the steel is deep, coarse polygonal ferrite tends to form in the portion. For a steel having a surface layer with such a microstructure, the resistance to outer surface SCC is lowered even when the steel has a good inner microstructure.

EXAMPLES

Next, examples of the present invention will be explained. A slab prepared by a converter-to-continuous casting process or a laboratory melting process was rolled to give a steel plate, and the steel was subjected to seamless pipe rolling to give a steel. The surface roughness of the steel was changed during the production by varying the surface condition of the slab using the procedure of descaling during rolling, the surface condition of the rolling rolls and the rolling conditions. The resistance to outer surface SCC of the steel was evaluated. Part of the steel was heat-treated after rolling to change the microstructure. Moreover, another part of the material was shot-blasted. Table 1 shows the chemical composition of the steel, and Table 2 shows the production process of the steel and the results of measuring the surface roughness.

TABLE 1

Chemical Compositions of Steels Used (mass %)

| No. | C | Si | Mn | P | S | Al | N | Nb |
|---|---|---|---|---|---|---|---|---|
| 1 | 0.045 | 0.23 | 1.35 | 0.006 | 0.0003 | 0.031 | 0.0028 | 0.045 |
| 2 | 0.075 | 0.22 | 1.29 | 0.011 | 0.0025 | 0.041 | 0.0046 | 0.037 |
| 3 | 0.062 | 0.24 | 1.94 | 0.003 | 0.0011 | 0.006 | 0.0026 | 0.031 |
| 4 | 0.08 | 0.25 | 1.55 | 0.008 | 0.0013 | 0.029 | 0.0028 | 0.029 |
| 5 | 0.16 | 0.26 | 1.3 | 0.009 | 0.004 | 0.026 | 0.0045 | 0.026 |
| 6 | 0.24 | 0.05 | 0.84 | 0.018 | 0.005 | 0.045 | 0.0055 | |

| No. | Ti | V | Mo | Cu | B | Others |
|---|---|---|---|---|---|---|
| 1 | 0.013 | 0.045 | | 0.29 | | Ca: 0.0019 |
| 2 | | | 0.16 | | | |
| 3 | 0.012 | | 0.21 | 0.4 | 0.0007 | Ni: 0.36 |
| 4 | 0.009 | | | | | |
| 5 | 0.017 | | | | | |
| 6 | | | | | | |

TABLE 2

Results of Measuring Roughness and Resistance to Outer Surface SCC

| Steel No. | Production process | Surface | Micro-structure | Ra (μm) | Rmax (μm) | σ th/ Yield strength (%) | |
|---|---|---|---|---|---|---|---|
| 1 | TMCP | as rolled | FB | 4 | 36 | 100 | |
| 1 | TMCP | as rolled | FB | 6.1 | 43 | 90 | |
| 1 | TMCP | as rolled | FB | 5.9 | 48 | 90 | |
| 1 | usual-rolled | as rolled | FP | 5.5 | 43 | 80 | |
| 2 | CR | as rolled | FA | 2.3 | 82 | 60 | * |
| 2 | CR | as rolled | FA | 4.5 | 45 | 90 | |
| 2 | CR | as rolled | FA | 6.4 | 48 | 70 | |
| 2 | QT | as rolled | FB | 6.6 | 47 | 75 | |
| 2 | CR | shot blasted | FA | 6.2 | 33 | 100 | |
| 3 | TMCP | as rolled | FB | 3.6 | 42 | 95 | |
| 3 | TMCP | as rolled | FB | 25 | 120 | 60 | * |
| 3 | TMCP | as rolled | FB | 3.8 | 28 | 100 | |
| 3 | TMCP | as rolled | FB | 12 | 45 | 65 | * |
| 3 | N | as rolled | FP | 4.1 | 32 | 80 | |
| 4 | QT | as rolled | FB | 2.5 | 26 | 95 | |
| 4 | QT | as rolled | FB | 5.4 | 42 | 85 | |
| 4 | QT | as rolled | FB | 6.5 | 45 | 80 | |
| 4 | N | as rolled | FP | 6.4 | 47 | 75 | |
| 5 | CR | as rolled | FP | 3.9 | 34 | 80 | |
| 5 | CR | as rolled | FP | 5.5 | 42 | 75 | |
| 5 | CR | as rolled | FP | 8.2 | 49 | 60 | * |
| 6 | usual-rolled | as rolled | FP | 5.1 | 47 | 70 | |

TABLE 2-continued

Results of Measuring Roughness and Resistance to Outer Surface SCC

| Steel No. | Production process | Surface | Micro-structure | Ra (μm) | Rmax (μm) | σ th/ Yield strength (%) | |
|---|---|---|---|---|---|---|---|
| 6 | usual-rolled | as rolled | FP | 15 | 54 | 50 | * |
| 6 | usual-rolled | shot blasted | FP | 5.6 | 42 | 90 | |

Note:
*: Comparative Example
FP: ferrite-pearlite CR: controlled-rolled
FA: acicular ferrite TMCP: CR + accelerated-cooled
FB: bainitic ferrite N: normalized
B: bainite QT: quenched-tempered The roughness was measured on the basis of JIS B0601. For each sample, the roughness was measured at three points, and the average value is shown. Since evaluation of a resistance to outer surface SCC on an actual buried line pipe was impossible, the resistance to outer surface SCC was evaluated by a laboratory test having been established as a reproducible one. Fundamentally, the test procedure was to observe the formation of outer surface SCC on a tensile test piece while a repeated load was being applied in an environment. The test piece was immersed in a solution at 75° C. containing 54 g of $Na_2CO_3$ and 84 g of $NaHCO_3$ per liter. The test piece was held in a potential region of −650 mV vs. SCE to form black magnetite on the surface. Repeated stress the upper limit of which was the yield strength and the lower limit of which was 70% of the yield strength was then applied to the test piece at a loading speed of 1,000 N/min for 14 days. The test piece had been tapered before the test so that the upper limit stress was varied from 100 to 50% of the yield strength within the single test piece, and the threshold stress (σth) which was the maximum stress at which outer surface SCC was not formed was determined.

Since a pipeline is usually designed so that the σth is 72% of the specified minimum yield strength, the steel can be regarded usable when the σth is at least 70% of the actual yield strength. It is evident from Table 2 that a steel having any of the chemical compositions in the table had a σth which was at least 70% of the yield strength so long as the steel was adjusted to have a surface roughness shown by the present invention. Moreover, it is clear that the steel showed a higher σth when the steel was shot-blasted, or the chemical composition was adjusted.

POSSIBILITY OF UTILIZATION IN THE INDUSTRY

The present invention can provide a steel excellent in resistance to outer surface SCC, when used for a pipeline, which resistance does not depend on the soundness of the coating, without impairing the low temperature toughness and field weldability and without involving a great rise in the cost. Consequently, the safety of the pipeline is significantly improved.

What is claimed is:

1. A steel pipe having resistance to outer surface stress corrosion cracking for use as a pipeline, wherein said steel has a surface adjusted to have a mean line roughness Ra of up to 7 μm and a maximum height Rmax of up to 50 μm.

2. The steel pipe having resistance to outer surface stress corrosion cracking for use as a pipeline as claimed in claim 1, wherein said steel comprises, based on mass, 0.03 to 0.16% of C, 0.5 to 2.0% of Mn, up to 0.5% of Si, up to 0.02% of P, up to 0.01% of S, up to 0.10% of Al, up to 0.1% of N, one or more kinds of the following elements in the following contents: 0.005 to 0.1% of Nb, 0.005 to 0.1% of Ti, 0.001 to 0.1% of V, 0.03 to 0.5% of Mo, 0.1 to 0.6%, of Cr, 0.1 to 0.8% of Ni, 0.1 to 0.8% of Cu, 0.0003 to 0.003% of B and 0.001 to 0.01% of Ca and the balance of substantially Fe and unavoidable impurities.

3. The steel pipe having resistance to outer surface stress corrosion cracking for use as a pipeline as claimed in claim 1, wherein said steel comprises, based on mass, 0.03 to 0.16% of C, 0.5 to 2.0% of Mn, up to 0.5% of Si, up to 0.02% of P, up to 0.01% of S, up to 0.10% of Al, up to 0.1% of N, one or more kinds of the following elements in the following contents: 0.005 to 0.1% of Nb, 0.005 to 0.1% of Ti, 0.001 to 0.1%; of V, 0.03 to 0.5% of Mo, 0.1 to 0.6% of Cr, 0.1 to 0.8% of Ni, 0.1 to 0.8% of Cu, 0.0003 to 0.003% of B and 0.001 to 0.01% of Ca and the balance of substantially Fe and unavoidable impurities, and said steel having, as the principal microstructure, acicular ferrite, bainitic ferrite or bainite.

4. A steel pipe having resistance to outer surface stress corrosion cracking for use as a pipeline, wherein said steel has a surface adjusted by shot blasting to have a mean line roughness Ra of up to 7 $\mu$m and a maximum height Rmax of up to 50 $\mu$m.

* * * * *